United States Patent [19]

Cantrell et al.

[11] Patent Number: 4,506,683

[45] Date of Patent: Mar. 26, 1985

[54] VENTILATED MOUTHPIECE FOR A SMOKING ARTICLE

[75] Inventors: Daniel V. Cantrell; Robert A. Sanford, both of Prospect, Ky.

[73] Assignee: Brown & Williamson Tobacco Corporation, Louisville, Ky.

[21] Appl. No.: 492,987

[22] Filed: May 9, 1983

[51] Int. Cl.[3] ..... A24D 3/04

[52] U.S. Cl. ..... 131/336; 131/339; 131/340

[58] Field of Search ..... 131/336, 339, 340

[56] References Cited

U.S. PATENT DOCUMENTS 4,386,618 6/1983 Cantrell ..... 131/336

*Primary Examiner*—V. Millin

*Attorney, Agent, or Firm*—Charles G. Lamb

[57] ABSTRACT

A ventilated mouthpiece adapted to be attached to a smoking article, such as a cigarette, includes a generally cylindrical core member of smoke and air impermeable material having a smoke inlet end and a mouth end. The smoke inlet end is to be placed in juxtaposition to one end of the tobacco column of the cigarette. The core member is formed with a plurality of smoke flow capillaries therethrough for delivering unfiltered smoke from the tobacco column to the mouth end of the core member, and at least one ventilation air flow channel which receives ambient ventilation air and delivers the ventilation air to the mouth end of the core member. The smoke outlets from the smoke flow capillaries at the mouth end of the core member are located at a further radial distance from the center of the core member than is the outlet from the at least one ventilation air flow channel.

20 Claims, 10 Drawing Figures

VENTILATED MOUTHPIECE FOR A SMOKING ARTICLE

BACKGROUND OF THE INVENTION (1) Field of the Invention

The present invention relates to smoke diluting devices, and more particularly to a mouthpiece for a cigarette, or the like, which delivers unfiltered smoke and ventilation air to the smoker's mouth in separate streams, causing dilution of the smoke within the smoker's mouth and turbulence to the smoke.

(2) Description of the Prior Art

It is well known in the art to add filters to cigarettes wherein the filters are provided with ventilating means to bring ambient air into the filter to dilute smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves in the smoker's mouth whereat the smoke is diluted. Examples of cigarette filters having grooves for the introduction of ventilating air into the filtering end are shown in the following patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways surrounding and extending parallel to the central passageway, and transverse passageways interconnecting the longitudinal passageways and central passageway with each other and with the ambient air. As the cigarette to which the device is smoked, smoke and ambient air traverses the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 shows a cigarette with a hollow mouthpiece which defines a smoke chamber. The smoke chamber is separated from he tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straight forward arrangement for a ventilated mouthpiece for a cigarette for lowering tar by ventilation. The present invention also provides a mouthpiece for a cigarette which enhances the perceived taste of a cigarette while lowering tar by ventilation. The present invention even further provides a mouthpiece of the class described which is adapted to produce a pressure drop and, therefore, draw effort which is less than the draw effort of a conventional filtered cigarette.

More particularly, the present invention provides a ventilated mouthpiece for a cigarette comprising a generally cylindrical core member fabricated of an air and smoke impermeable material, the core member having the smoke inlet end and mouth end; means defining at least one ventilating air flow channel extending through at least a portion of the core member, the at least one air flow channel being open to the mouth end of the core member providing for the flow of only ventilating air therethrough to the outside of the core member at the mouth end; means providing for the flow of only ventilating air into the at least one ventilating air flow channel; means defining a plurality of smoke flow capillaries extending through the core member, each smoke flow capillary being open to the smoke inlet end of the core member and open to the mouth end of the core member providing for the flow therethrough of only smoke from the inlet end of the core member to the outside of the core member at the mouth end; and, the openings of the smoke flow capillaries at the mouth end of the core member being disposed in a circumscribing array about the opening of the at least one ventilating air flow channel at the mouth end of the core member.

It is to be understood that the description of the following examples of the present invention given hereinafter are not by way of limitation and various modifications will occur to those skilled in the art upon reading the disclosure set forth hereinafter.

BRIEF DESCRIPTION OF THE DRAWINGS

The various features and advantages of the present invention will become clear upon reference to the following description and accompanying drawings wherein like numerals refer to like parts throughout, and in which.

DESCRIPTION OF THE PREFERRED EMBODIMENTS

Figure 1:
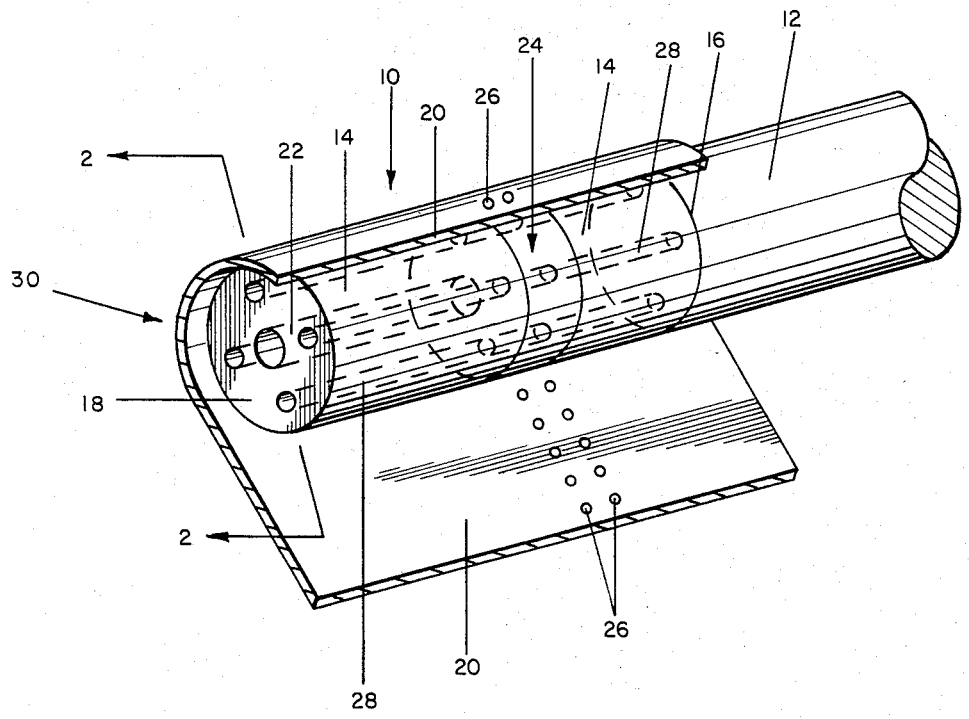
FIG. 1 is a perspective view of one advantageous embodiment of a mouthpiece of the present invention, attached to a cigarette tobacco column.
Figure 2:
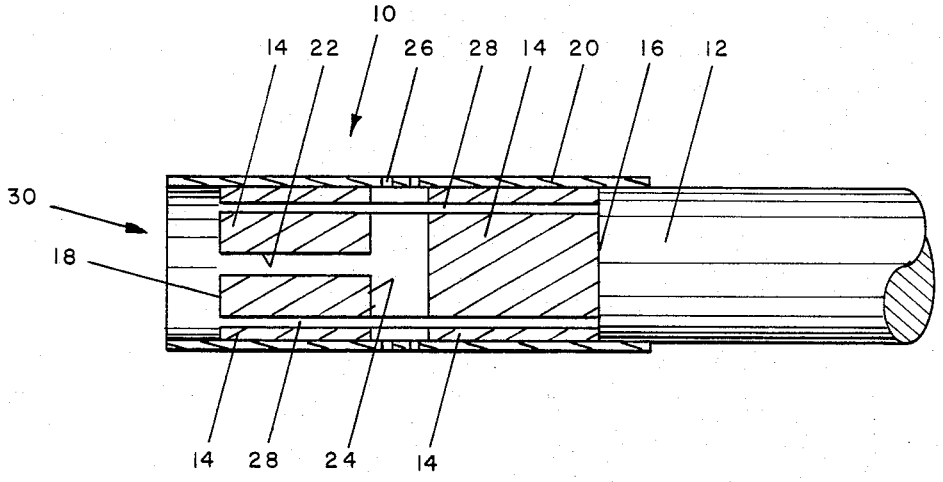
FIG. 2 is a longitudinal cross-sectional view of the mouthpiece of FIG. 1 as viewed in the direction of arrows 2—2 in FIG. 1.

FIGS. 1 and 2 show one advantageous embodiment of a ventilated mouthpiece, generally denoted as the number 10, of the present invention attached to a cigarette tobacco column 12. The mouthpiece 10 is shown as comprising a generally cylindrical core member 14, fabricated of an air and smoke impermeable material, and having a smoke inlet end 16 and a mouth end 18. The core member 14 is coaxially located at one end of the tobacco column 12 with the inlet end 16 in juxtaposition to the end of the tobacco column 12. The core member 14 is shown as being attached to the tobacco column 12 by air permeable tipping material 20 which circumscribes the core member 14 and overlaps a portion of the tobacco column 12. In FIG. 1, the tipping material 20 is shown in a partially unwrapped position to more clearly show details of the core member 14.

The core member 14 includes at least one ventilating air channel 22 extending through at least a portion of the core member 14. The ventilating air channel 22 is shown as being longitudinally coaxially formed in the core member 14 and open to the mouth end 18 of the core member 14 for delivering ventilating air therethrough to the outside of the core member at the mouth end 18. The flow of only ventilating air into the ventilating air flow channel 22 is accomplished by means of a ventilating air plenum chamber 24 in the core member 14 between the smoke inlet end 16 and mouth end 18 of the core member 14. The ventilating air channel 22 is open to the air plenum chamber 24 providing air flow communication from the ventilating air plenum chamber 24 to the exterior of the core member 14 at the mouth end 18. The flow of only ventilating air into the ventilating air plenum chamber 24 is shown as being accomplished by means of the air permeable tipping material 20. For the sake of illustration, the air permeability is provided by means of small perforations 26 formed through the tipping material communicating with the ventilating air plenum chamber 24. Alternately, the tipping material 20 can be fabricated of a porous material.

The core member 14 further comprises a plurality of smoke flow capillaries 28 extending through the core member 14 from the smoke inlet end 16 to the mouth end 18. Each smoke flow capillary is open to the smoke inlet end 16 of the core member 14 and open to the mouth end 18 of the core member 14, thus, providing for the flow of only smoke through the capillaries 28 from the inlet end 16 to the outside of the core member 14 at the mouth end 18. The outlet openings of the smoke flow capillaries 28 at the mouth end 18 of the core member 14 are located in a circumscribing array about the outlet opening of the ventilating air channel 22 at the mouth end 18 of the core member 14. That is, the smoke outlet openings of the smoke capillaries at the mouth end 18 are spaced generally radial outwardly of the air oulet opening of the ventilating air channel 22 at the mouth end 18 of the core member 14 so that the smoke outlet openings are closer to the perimeter of the core member 14 than is the air outlet opening. Preferably, the smoke outlet openings are as close as practically possible to the perimeter of the core member 14.

While, by way of example, four smoke flow capillaries 28 are illustrated in FIGS. 1-2, it has been found that advantageous results are obtained using from three to seven smoke capillaries 28. Furthermore, it has been determined that the cross-sectional area of each smoke capillary should be on the order of from about 0.00125 $cm^2$ to about 0.00385 $cm^2$ with a total ventilating air to smoke flow ratio of about 3 to 1.

As illustrated, the mouth end 18 of the core member 14 is recessed from the mouth end of the ventilated mouthpiece 10 providing a recessed area 30. In FIGS. 1 and 2, the recessing accomplished by extending the circumscribing tipping material 20 in a longitudinal direction of the core member 14 beyond the mouth end 18 of the core member 14. Thus, both the outlet openings of the ventilation air channel 22 at the mouth end 18 of the core member 14 are recessed inwardly of the mouth end of the ventilated mouthpiece 10.

When a smoker draws on the ventilated mouthpiece 10, ventilating air is drawn into the air plenum chamber 24 through the perforations 26 in the tipping material 20. The air flows from the plenum chamber 24 through the ventilating air channel 22 and is discharged at approximately the center of the core member 14 at the mouth end 18. The ventilating air plenum chamber 24 functions to control the pressure drop of the ventilating air flowing into the ventilation air channel 22 from the ambient. Concurrently, the smoke from the tobacco column 12 is drawn into the smoke flow capillaries through their openings at the smoke inlet end 16 of the core member 14 and is delivered, unfiltered, to the mouth end 18 of the core member 14 through the outlet openings of the smoke capillaries 28 at the mouth end 18 of the core member 14. The ventilating air from the air channel 22 co-mingles with the unfiltered smoke from the capillaries 28 in the recesses area 30 of the mouthpiece 10 diluting the smoke and causing turbulence. The air leaving the mouth end 18 of the core member 14 at the center of the mouth end also tends to cause the diluted smoke to leave the mouth end of the mouthpiece which results in an enhanced perception of taste to the smoker because the smoke leaves the mouthpiece 10 in close proximity to the smoker's "taste buds".

Figure 3:
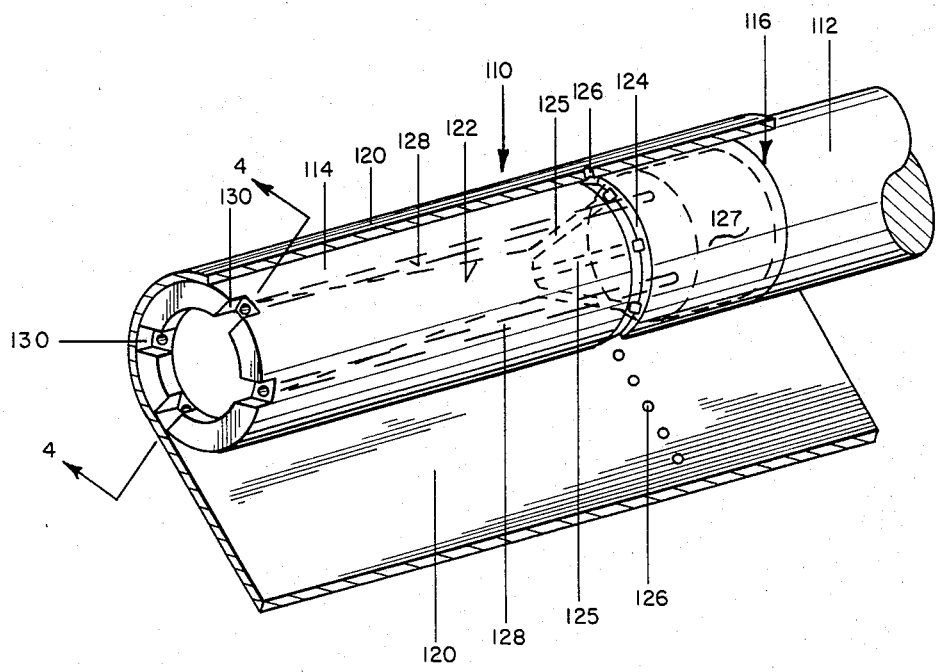
FIG. 3 is a perspective view of another advantageous embodiment of a mouthpiece of the present invention attached to a cigarette tobacco column.
Figure 4:
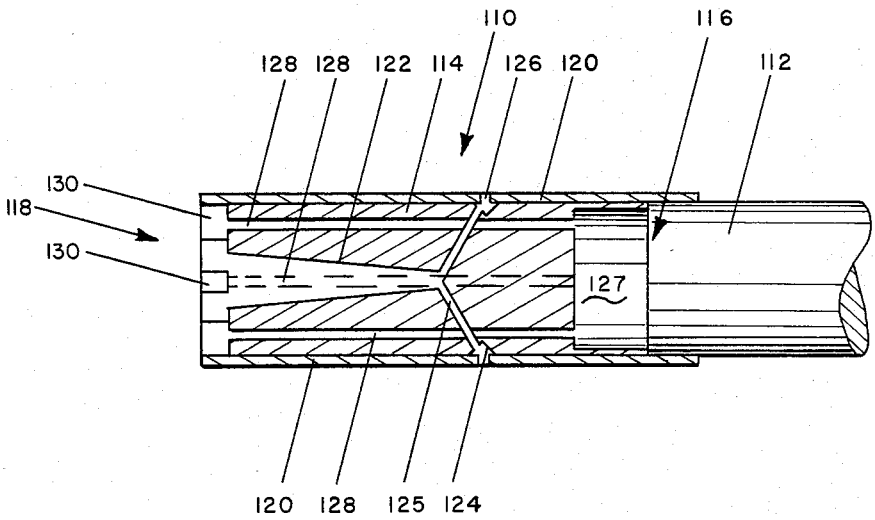
FIG. 4 is a longitudinal cross-sectional view of the mouthpiece of FIG. 3 as viewed in the direction of arrows 4—4 in FIG. 3.

Now with reference to FIGS. 3 and 4, there is illustrated another advantageous embodiment of a ventilated mouthpiece, generally denoted as the number 110, of the present invention attached to a cigarette tobacco column 112. The mouthpiece 110 is shown as comprising a generally cylindrical core member 114, fabricated of an air and smoke impermeable material, and having a smoke inlet end 116 and a mouth end 118. The core member 114 is coaxially located at one end of the tobacco column 112 with the inlet end 116 in juxtaposition to the end of the tobacco column 112. The core member 114 is shown as being attached to the tobacco column 112 by air permeable tipping material 120 which circumscribes the core member 114 and overlaps a portion of the tobacco column 112. In FIG. 3 the tipping material 120 is shown in a partially unwrapped position to more clearly show details of the core member 114.

The core member 114 includes at least one ventilating air channel 122 extending through at least a portion of the core member 114. The ventilating air channel 122 is shown as being generally longitudinally, coaxially formed in the core member 114 and open to the mouth 118 of the core member 114 for delivering ventilating air therethrough to the outside of the core member at the mouth end 118. The ventilating air channel 122 is further shown as diverging in the direction toward the mouth end 118 of the core member. The flow of only ventilating air into the ventilating air channel 122 is accomplished by means of an annular ventilation air accumulation groove 124 formed in the perimeter of the core member 114. The ventilation air channel 122 is in air flow communication with the annular groove 124 by means of branch channels 125, each of which have one end open to the ventilating air channel 122 and another end open to the annular groove 124. The openings of the branch channels 125 in the annular groove 124 are preferably equally spaced about the groove 124. The flow of ventilating air from the ambient into the ventilating air accumulation groove 124 is shown as being accomplished by means of the air permeable tipping material. For example, the air permeability is provided by means of small perforations 126 formed through the tipping material communicating with the ventilating air accumulation groove 124. The tipping material 120 could be fabricated of a porous material thereby eliminating the air flow perforations 126.

The core member 114 further comprises a smoke plenum chamber 127 formed at the inlet and 116 of the core member 114 and open to the tobacco column 112 and a plurality of smoke flow capillaries 128 extending through the core member 114 from the smoke plenum chamber 127 at the smoke inlet and 116 to the mouth end 118 of the core member 114. Each smoke flow capillary 128 is open to the smoke plenum chamber 116 and open to the mouth end 118 of the core member, thus, providing for the flow of only smoke through the capillaries 128 from the smoke plenum chamber 127 at the inlet end 116 to the outside of the core member 114 at the mouth end 118. The outlet openings of the smoke flow capillaries 128 at the mouth end 118 of the core member 114 are located in a circumscribing array about the outlet openings of the ventilating air channel 122 at the mouth end 118 of the core member 114 such that the smoke outlet openings of the smoke capillaries 128 at the mouth end 118 are spaced outwardly from the air outlet opening of the ventilating air channel 122 generally radially of the core member 114 so that the air outlet openings are closer to the perimeter of the core member than is air outlet opening. Preferably, the smoke outlet openings are as close as practically possible to the perimeter of the core member 114.

For the sake of clarity of the drawings, four smoke capillaries 128 are shown in the embodiment of FIGS. 3–4, however, it should be clearly understood that the core member 114 can be advantageously formed with more or fewer smoke capillaries 128. It has been determined that the cross-sectional area of each smoke flow capillary 128 should be on the order of from about 0.00125 $cm^2$ to about 0.00385 $cm^2$ and that the at least one air flow channel 122 be sized so that a total air flow to smoke flow ratio of about 3 to 1 is provided.

As illustrated, the smoke outlet openings at the mouth end 118 of the core member 114 are recessed inwardly of the mouth end 118. In the embodiment of FIGS. 3 and 4, the recessing of the smoke outlet openings of the smoke capillaries 128 is accomplished by forming cavities 130 into which the smoke from the capillaries is discharged. The cavities 130 are formed in the mouth end 118 of the core member 114 in the wall portion of the core member 114 defining the ventilation air channel 122 and are open both to the mouth end 118 and ventilation air channel 122.

When a smoker draws on the ventilated mouthpiece 110, ventilating air is drawn into the annular air accumulation groove 124 through the perforations 126 in the tipping material 120. The air flows from the air accumulation groove 124, through the branch channels 125, into ventilation air channel 122 and is discharged at approximately the center of the core member 114 at the mouth end 118. The annular accumulation groove 124 functions in the manner of a plenum to control the pressure drop of the ventilating air flowing into the ventilation channel 122. At the same time, smoke from the tobacco column 112 is drawn into the smoke plenum chamber 127, from the smoke plenum chamber through the smoke flow capillaries 128 and is discharged into the open cavities 130 at the mouth end 118 of the core member 114. The ventilating air from the air channel 122 co-mingles with the unfiltered smoke from the capillaries 128 diluting the smoke and causing turbulence. The air leaving the diverging air channel 122 at the mouth end 118 of the core member 114 flows generally radially outwardly of the mouthpiece carrying the diluted smoke with it which results in an enhanced perception of taste to the smoke.

Figure 5:
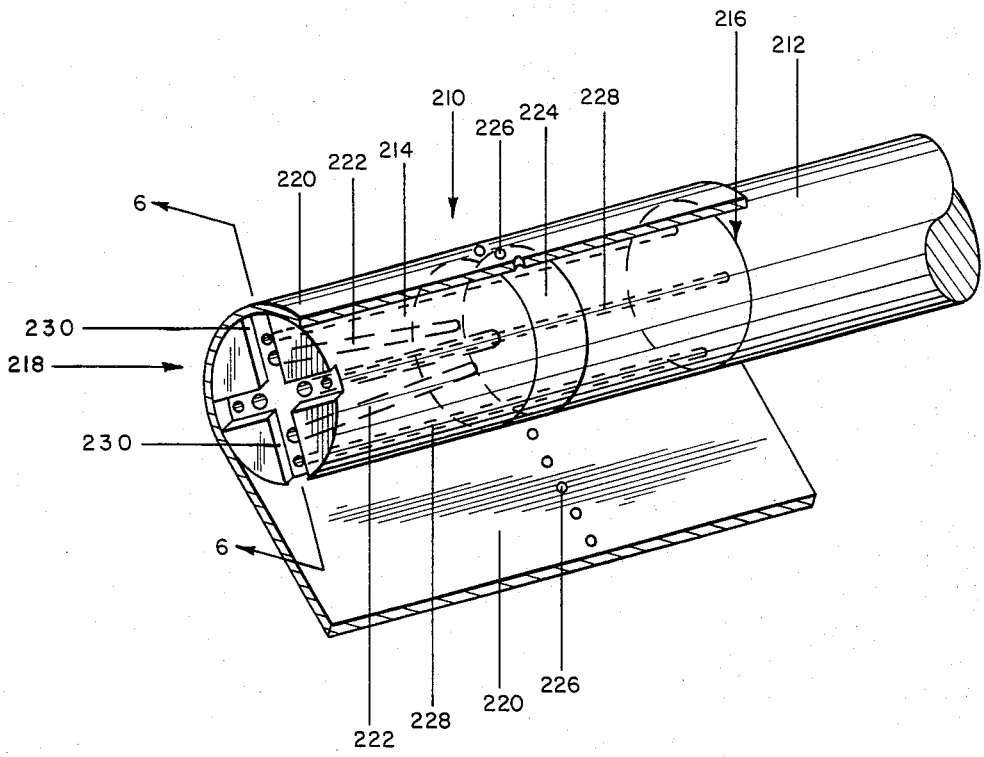
FIG. 5 is a perspective view of a further advantageous embodiment of a mouthpiece of the present invention attached to a cigarette tobacco column.
Figure 6:
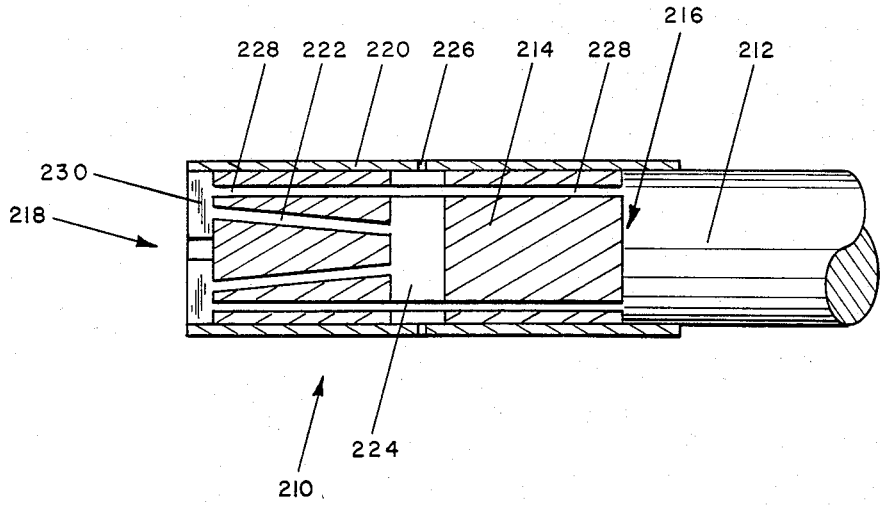
FIG. 6 is a longitudinal cross-sectional view of the mouthpiece of FIG. 5 as viewed in the direction of arrows 6—6 in FIG. 5.

FIGS. 5 and 6 illustrate a further advantageous embodiment of a ventilated mouthpiece, generally denoted as the number 210, of the present invention attached to a cigarette tobacco column 212. The mouthpiece 210 is illustrated as comprising a generally cylindrical core member 214, fabricated of an air and smoke impermeable material and having a smoke inlet end 216 and a mouth end 218. The core member 214 is coaxially located at one end to the tobacco column 212 with the inlet end 216 in juxtaposition to the end of the tobacco column 212. The core member 214 is shown as being attached to the tobacco column 212 by air permeable tipping material 220 which circumscribes the core member 214 and overlaps a portion of the tobacco column 212. In FIG. 5 the tipping material 220 is shown in a partially unwrapped position to more clearly show details of the core member 214.

The core member 214 includes a plurality of ventilating air channels 222 extending through at least a portion of the core member 214. The ventilating air channels 222 are shown as arranged in a circumscribing array about the longitudinal axis of the core member 214 with the longitudinal axis of the air channels 222 oriented at an angle to the longitudinal axis of the core member such that the air channels angle outwardly toward the perimeter of the core member 214 in a direction toward the mouth end 218 of the core member and, thus, mutually diverge in the direction toward the mouth end 218. Each of the air channels 222 is open to the mouth end 218 of the core member at the mouth end 218. The flow of only ventilating air into the ventilating air channels 222 is accomplished by means of a ventilating air plenum chamber 224 in the core member 214 between the smoke inlet end 216 and mouth end 218 of the core member 214. The ventilating air channels 222 are open to the air plenum chamber 224 is shown as being accomplished by means of the air permeable tipping material 220. By way of example, the air permeability is provided by means of small perforations 226 formed through the tipping material communicating with the ventilation air plenum chamber 224. Alternately, the tipping material can be fabricated of a porous material.

The core member 214 further comprises a plurality of smoke flow capillaries 228 extending through the core member 214 from the smoke inlet end 216 to the mouth end 218. Each smoke flow capillary 228 is open to the smoke inlet end 216 of the core member 214 and open to the mouth end 218 of the core member, thus, providing for the flow of only unfiltered smoke through the capillaries 228 from the inlet end 216 to the outside of the core member 214 at the mouth end 218. As illustrated, the number of smoke flow capillaries 228 is equal to the number of ventilating air channels 224. The outlet openings of the smoke flow capillaries 228 at the mouth end 218 of the core member 214 are disposed in a circumscribing array around the outlet openings of the ventilation air channels 222 at the mouth end 218 so that the smoke outlet openings are closer to the perimeter of the core member 214 than are the air outlet openings. In addition, as shown by way of example, the outlet openings of each smoke flow capillary 228 at the core mouth end 218 is grouped in close proximity to, and in generally radial alignment with a different one of the outlet openings of an air channel 222 at the core mouth end 218. Preferably, the smoke outlet openings are as close as practical to the perimeter of the core member 214, and the air outlet openings are as close as practical to the smoke outlet openings.

For the sake of simplicity of understanding, the embodiment of FIGS. 5 and 6 are illustrated as including four smoke capillaries 228 and four air channels 222. However, it should be understood that advantageous results derived from the present invention are obtained by forming three to seven smoke capillaries 228 in the core member 214. Further, regardless of the number of smoke capillaries, from three to seven, it has been determined that the cross-sectional area of each smoke capillary 228 be on the order of from about 0.00125 $cm^2$ to about 0.00385 $cm^2$. In addition, while forming the core member 14 with the same number of air channels 222 as smoke capillaries 228 has the feature of providing for the direct impingement of each ventilation air stream into a different one of the smoke streams, an unequal number of ventilation air channels 222 and smoke capillaries 228 can be incorporated into the core member 214, as long as each smoke stream is impinged by at least one ventilation air stream. Regardless of the number of ventilation air channels 222 formed in the core member 214, an air flow to smoke flow ratio of approximately 3 to 1 should be maintained.

As shown, the open smoke outlets from the smoke capillaries 228 and the open ventilating air outlets from the air channels 222 are recessed inwardly of the core mouth end 218. The recessing of the open smoke outlets and open air outlets is accomplished by forming cavities 230 into which the smoke and ventilating air are discharged. The number of cavities 230 is equal to the number of grouped air and smoke outlet openings, and a different grouped pair of air and smoke outlets discharge air and smoke in separate streams into a different cavity 230. Each cavity 230 extends from the perimeter of the core member 214 generally radially of the core member toward the center thereof. As shown, each cavity 230 is open to the core mouth end 218 and all of the cavities 230 are in mutual flow communication at the proximate center of the core member 218.

When a smoker draws on the ventilated mouthpiece 210, ventilating air is drawn into the air plenum chamber 224 through the perforations 226 in the tipping material 220. The air flows from the plenum chamber 224 through the ventilating air channels 222, and is discharged in a generally radial outward direction of the core member 214 through the openings at the mouth end 218 into the cavities 230. Simultaneously, smoke from the tobacco column 212 is drawn into the smoke flow capillaries 228 through their openings at the inlet end 218 of the core member 214 and is delivered, unfiltered to the cavities 230 at the mouth end 218 of the core member through the openings of the capillaries at the core mouth end. The radial outward angle of the ventilation air channels 222 directs the flow of ventilating air exiting therefrom in a generally radially outward direction of the core member and into the flow of smoke issuing from the openings of the smoke capillaries 228 diluting the smoke, creating turbulence therein and carrying the smoke generally radially outwardly of the mouthpiece into close proximity to the smoker's ∓taste buds".

Figure 7:
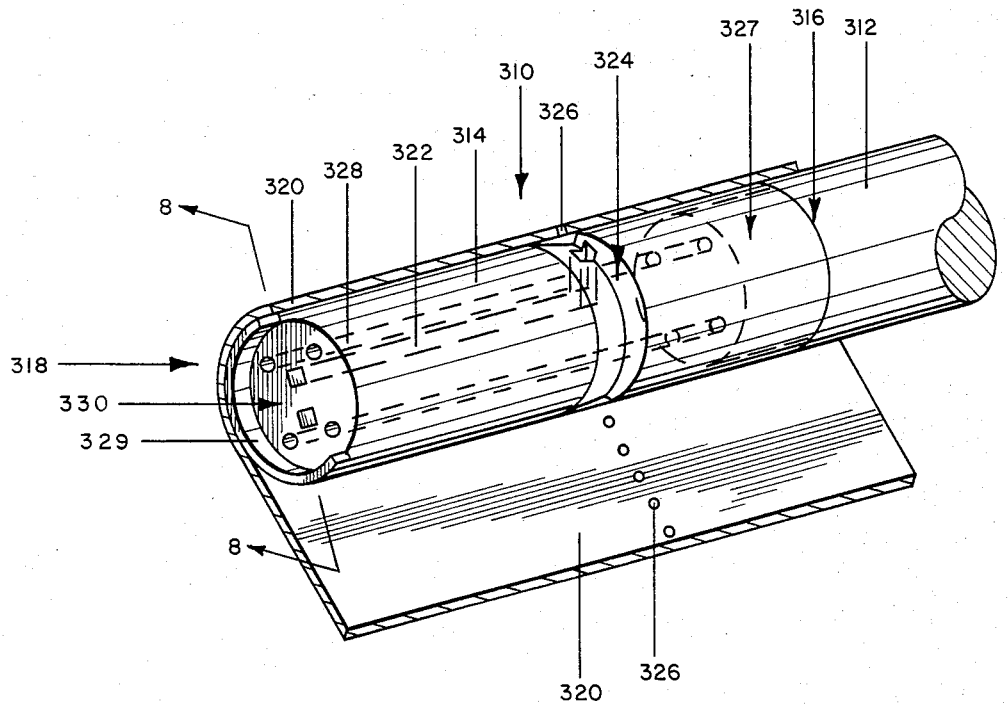
FIG. 7 is a perspective view of yet a further advantageous embodiment of a mouthpiece of the present invention attached to a cigarette tobacco column.
Figure 8:
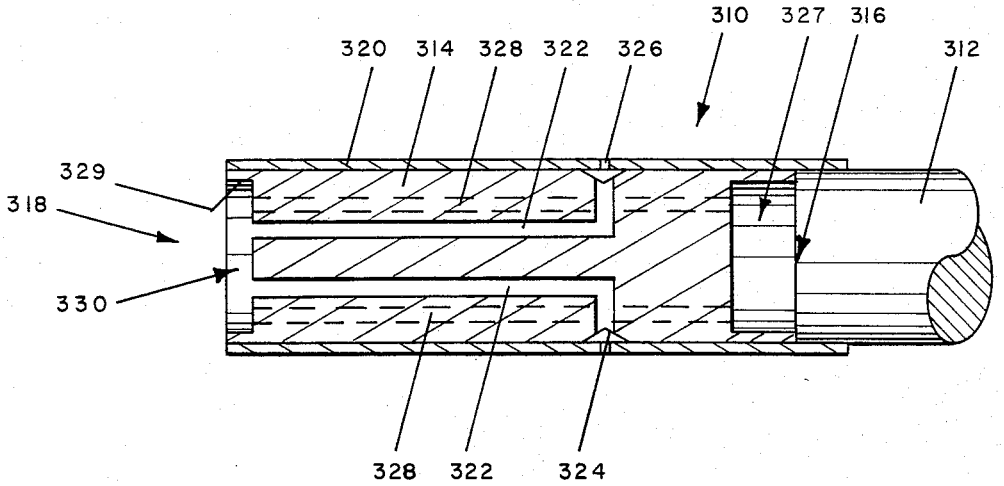
FIG. 8 is a longitudinal cross-sectional view of the mouthpiece of FIG. 7 as viewed in the direction of arrows 8—8 in FIG. 7.

Turning now to FIGS. 7 and 8, there is shown yet a further advantageous embodiment of a ventilated mouthpiece, generally denoted as the numeral 310, of the present invention attached to a cigarette tobacco column 312. The mouthpiece 310 is shown as including a generally cylindrical core member 314, fabricated of an air and smoke impermeable material, and having a smoke inlet end 316 and a mouth end 318. The core member 314 is coaxially located at one end of the tobacco column 312 with the inlet end 316 in juxtaposition to the end of the tobacco column 312. The core member 314 is shown as being attached to the tobacco column 312 by air permeable tipping material 320 which circumscribes the core member 314 and overlaps a portion of the tobacco column 312. In FIG. 7 the tipping material 320 is shown in a partially unwrapped position to more clearly show details of the core member 314.

As illustrated, the core member 314 includes two ventilating air channels 322 extending through at least a portion of the core member 314. The ventilating air channels 322 are shown as extending generally longitudinally of the core member 314 and being circumferentially spaced from each other by approximately 180°. Further, each of the ventilating air channels 322 are open to the mouth end 318 of the core member 314 for delivering ventilating air therethrough to the outside of the core member at the mouth end 318. While the ventilating air channels 322 are shown as being substantially parallel to the longitudinal axis of the core member 314, it is contemplated that they can be formed to mutually diverge in the direction of air flow toward the core mouth end 318 in a similar manner to the air channels 222 of the mouthpiece 210 of FIGS. 5 and 6. The flow of only ventilating air into the ventilating air channels 322 is accomplished by means of an annular ventilation air accumulation groove 324 formed in the perimeter of the core member 314. Each of the ventilation air channels 322 is open to the air accumulation groove 324 providing air flow communication from the air accumulation groove 324 to the exterior of the core member 314 at the mouth end 318. The flow of only ventilating air into the ventilating air accumulation groove 324 is shown as being accomplished by means of the air permeable tipping material 320. By way of example, the air permeability is provided by means of small perforations 326 formed through the tipping material communicating with the air accumulation annular groove 324. Alternatively, the tipping material can be fabricated of a porous material.

The core member 314 also includes a smoke plenum chamber 327 formed at the inlet end 316 of the core member 314 and open to the tobacco column 312. A plurality of smoke flow capillaries 328 extend through the core member 314 from the smoke plenum chamber 327 at the core member inlet end 316 to the core member outlet end 318. Each smoke flow capillary 328 is open to the smoke plenum chamber 327 and open to the core mouth end 318, thus, providing for the flow of only smoke through the capillaries 328 from the smoke plenum chamber 327 to the outside of the core member 314 at the mouth end 318. The outlet openings of the smoke flow capillaries 328 at the core mouth end 318 are located, generally, in a circumferential array about the outlet openings of the ventilating air channels 322 at the mouth end 318 of the core member 314 such that the smoke outlet openings of the smoke capillaries 328 at the mouth end 318 are spaced radially outwardly from the air outlet openings of the ventilating air channels 322 so that the smoke outlet openings are generally closer to the perimeter of the core member 314 than are the air outlet openings. As illustrated in FIG. 7, four smoke capillaries 328 are formed through the core member 314 with the smoke outlet openings of two of the smoke capillaries 328 being located to either side of and spaced radially outwardly from the air outlet opening of one of the air channels 322, and the smoke outlet openings of the other two smoke capillaries 328 being located to either side of and spaced radially outwardly from the air outlet opening of the other one of the air channels 322.

As illustrated in FIGS. 7 and 8, the open smoke outlets from the smoke capillaries 328 and the open ventilating air outlets from the ventilating air channels 322 are recessed. Toward this end, the peripheral margin 329 of the core member 314 projects beyond the mouth end 318 so as to define an open cavity 330 into which the smoke from the smoke capillaries 328 and ventilating air from the air channels 322 discharges. As with the previously discussed embodiments, advantageous results have been obtained by forming each of the smoke capillaries 328 with a cross-sectional area of from about 0.00125 $cm^2$ to about 0.00385 $cm^2$ and sizing the air channels 322 accordingly to provide a total ventilation air to smoke ratio of approximately 3 to 1.

When a smoker draws on the ventilated mouthpiece 310, ventilating air is drawn into the ventilating air accumulation groove 324 through the perforations 326 in the tipping material 320. The air flows from the annular groove 324 through the ventilating air channels 322, and is discharged through the air outlet openings at the core mouth end 318 into the cavity 330. Simultaneously, smoke from the tobacco column 312 is drawn into the smoke flow capillaries 328 from the smoke plenum chamber 327 through their openings at the core inlet end 316 and is delivered, unfiltered, into the cavity 330 at the core mouth end 318. The smoke is diluted by the air streams within the cavity 330, which also causes turbulent flow therein, and leaves the mouthpiece in close proximity to the smoker's "taste buds".

It is contemplated, in regard to all of the illustrated embodiments, that some of the smoke flow capillaries be of smaller diameter than other smoke flow capillaries to provide, what is termed in the industry, a programmed smoke flow to the mouth end of the core member. As the cigarette is smoked, the smoke flow capillaries become blocked reducing the smoke flow therethrough. By varying the diameters of some of the smoke flow capillaries, the rate at which the various capillaries become progressively blocked can be adjusted to provide a gradual, programmed reduction in the amount of smoke delivered to the mouth end of the core member as the cigarette is smoked.

Figure 9:
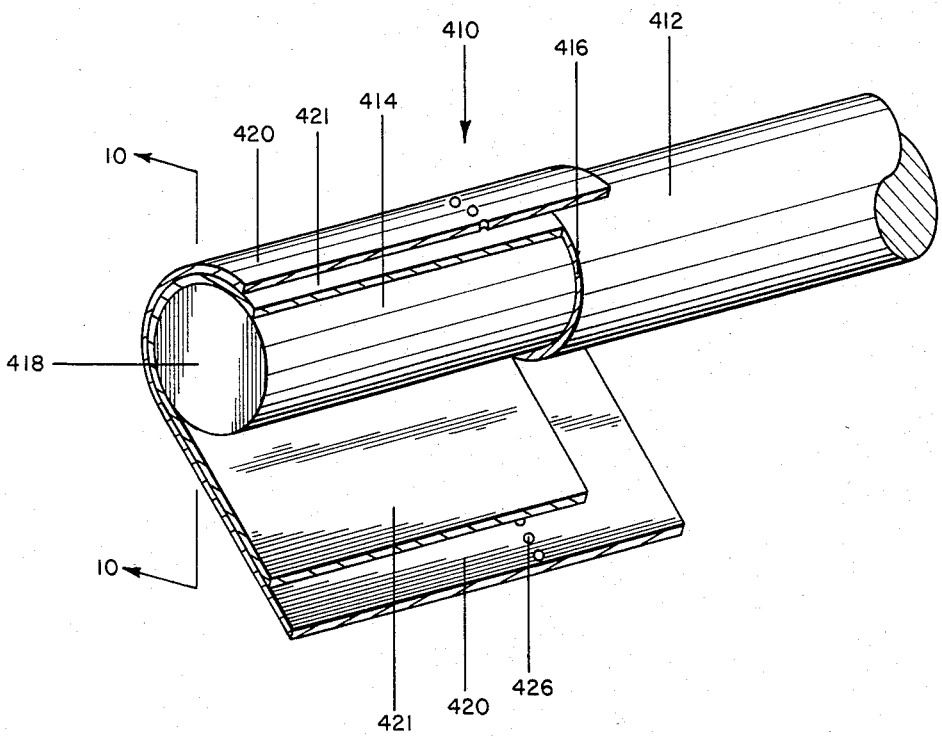
FIG. 9 is a perspective view of a mouthpiece of the present invention circumscribed by an air permeable wrapper and attached to a cigarette tobacco column by air permeable tipping material; and, FIG. 10 is a longitudinal cross-sectional view of the cigarette assembly of FIG. 9 as viewed in the direction of arrows 10—10 in FIG. 9.
Figure 10:
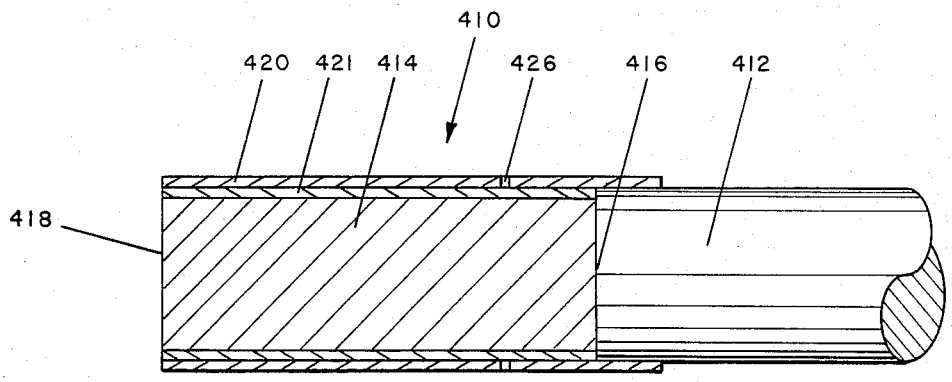

With reference to FIGS. 9 and 10, there is shown a ventilated mouthpiece, generally denoted as the number 410, attached to a cigarette tobacco column 412. The mouthpiece 410 is shown as comprising a generally cylindrical core member 414 fabricated of an air and smoke impermeable material and having a smoke inlet end 416 and a mouth end 418. It should be clearly understood that the core member 414 is generic to all of the above discussed core members, i.e., any of the core members can be considered to be the core member 414. Therefore, no details of the smoke capillaries and air flow channels are shown in FIGS. 9 and 10, nor will they be discussed hereinafter. The core member 414 is coaxially located at one end of the tobacco column 412 with the inlet end 416 in juxtaposition to the end of the tobacco column 412. It is foreseeable that the core member 414 will be fabricated of a relatively hard, smooth plastic material to which it may be difficult to adhesively attach a tipping material 420. As illustrated, to overcome this potential problem, the core member is circumscribed with an air permeable wrapper 421, and the wrapped core member is attached to the tobacco column 412 by the air permeable tipping material 420 which circumscribes the wrapped core member and overlaps a portion of the tobacco column 412. The tipping material is adhesively secured to the wrapper 421 and the overlapped portion of the tobacco column 412. In FIG. 9, both the air permeable wrapper 421 and air permeable tipping material 420 are shown in a partially unwrapped position to more clearly show their relationship with the core member 414. In order to compensate for the thickness of the air permeable wrapper 421, it is contemplated that the diameter of the core member 414 be smaller than the diameter of the tobacco column 412 by an amount substantially equal to twice the thickness of the air permeable wrapper 421 so that the perimeter of the wrapped core member is generally coextensive with the perimeter of the tobacco column.

The foregoing detailed description is given primarily for clearness of understanding and no unnecessary limitations are to be understood therefrom for modifications will be come obvious to those skilled in the art upon reading this disclosure and can be made without departing from the spirit of the invention or scope of the appended claims.

What is claimed is:

1. A ventilated mouthpiece for a cigarette, the mouthpiece comprising:

a generally cylindrical core member fabricated of an air and smoke impermeable material, the core member having a smoke inlet end and mouth end;

means defining at least one ventilating air flow channel extending through at least a portion of the core member, the at least one air flow channel having an open outlet to the mouth end of the core member providing for the flow of only ventilating air therethrough to the outside of the core member at the mouth end;

means providing for the flow of only ventilating air into the at least one ventilating air flow channel;

means defining a plurality of smoke flow capillaries extending through the core member from the smoke inlet end to the mouth end of the core member, each smoke flow capillary being open to the smoke inlet end of the core member and having an open outlet to the mouth end of the core member providing for the flow therethrough of only smoke from the inlet end of the core member to the outside of the core member at the mouth end; and the outlet openings of the smoke flow capillaries at the mouth end of the core member being located generally closer to the perimeter of the core member than the outlet opening of the at least one ventilating air flow channel at the mouth end of the core member.

2. The mouthpiece defined in claim 1, wherein the at least one ventilation air flow channel is generally concentrically located with the longitudinal axis of the core member.

3. The mouthpiece defined in claim 1, wherein the means providing for the flow of only ventilating air into the at least one ventilating air flow channel comprises:

means defining a ventilating air plenum chamber in the core member between the smoke inlet end and mouth end of the core member, the at least one ventilating air flow channel being open to the ventilating air plenum; and means providing for the flow of only ventilating air into the ventilating air plenum chamber.

4. The mouthpiece defined in claim 1, wherein the at least one air flow channel diverges in the direction toward the mouth end of the core member.

5. The mouthpiece defined in claim 1, wherein the means providing for the flow of only ventilating air into the at least one ventilating air flow channel comprises:

means defining an annular groove in the perimeter of the core member, the at least one ventilating air flow channel being in air flow communication with the annular groove; and, means providing for the flow of only ventilating air into the annular groove.

6. The mouthpiece of claim 1, wherein the outlet openings of the plurality of smoke flow capillaries at the mouth end of the core member are recessed inwardly of the mouth end of the mouthpiece.

7. The mouthpiece of claim 1, wherein the outlet opening of the at least one ventilation air flow channel at the mouth end of the core member is recessed inwardly of the mouth end of the mouthpiece.

8. The mouthpiece defined in claim 1, wherein the at least one ventilating air flow channel comprises a plurality of ventilating air flow channels, and the outlet opening of each of the plurality of smoke flow capillaries is in close proximity to at least one of the outlet openings of the ventilating air flow channels.

9. The mouthpiece of claim 8, wherein the ventilating air channels are oriented at an angle to the longitudinal axis of the core member outwardly toward the perimeter of the core member in a direction toward the mouth end of the core member for directing the flow of air exiting therefrom in a generally radially outward direction of the core member.

10. The mouthpiece defined in claim 8, wherein each smoke outlet opening is in generally radial alignment with a different one of the ventilating air outlet openings.

11. The mouthpiece of claim 10, further comprising means defining a plurality of generally radially extending cavities formed in and open to the mouth end of the core member, the number of open cavities being equal to the number of smoke flow capillaries, and the opening of each of the capillaries and the opening of the ventilating channel in radial alignment therewith at the mouth end of the core member being in flow communication with a different one of the open cavities.

12. The mouthpiece of claim 11, wherein all of the open cavities are in mutual flow communication at the proximate center of the core member.

13. The mouthpiece of claim 1, further comprises means defining a plurality of generally radially extending cavities formed and open to the mouth end of the core member, the number of open cavities being equal to the number of smoke flow capillaries, and the openings of each of the smoke flow capillaries at the mouth end of the core member being in flow communication with a different one of the open cavities, and the opening of the at least one ventilating air channel being in flow communication with all of the open cavities.

14. The ventilated mouthpiece of claim 1, further comprising means defining a smoke plenum chamber in the core member; the plurality of smoke flow capillaries being in smoke flow communication with the smoke plenum chamber for receiving smoke therefrom.

15. The ventilated mouthpiece of claim 1, wherein the smoke flow capillaries and ventilation air channels provide a total ventilating air to smoke ratio of approximately 3 to 1.

16. The ventilated mouthpiece of claim 1, wherein the cross-sectional area of each of the smoke flow capillaries is on the order of from about 0.00125 $cm^2$ to about 0.00385 $cm^2$.

17. The ventilated mouthpiece of claim 1, wherein the means providing for the flow of only ventilating air into the at least one ventilating air flow channel comprises air permeable tipping material circumscribing the core member.

18. A cigarette comprising:

a tobacco column;

a generally cylindrical core member fabricated of air and smoke impermeable materials, the core member having a smoke inlet end and a mouth end, and the core member being coaxially located at one end of the tobacco column with the smoke inlet end in juxtaposition to the end of the tobacco column;

means defining at least one ventilating air flow channel through at least a portion of the core member and having an open outlet air outlet to the mouth end of the core member;

means defining a plurality of smoke flow capillaries extending through the core member from the smoke inlet end to the mount end of the core member;

the outlet openings of the smoke flow capillaries at the mouth end of the core member being located closer to the perimeter of the core member than the outlet opening of the at least one ventilating air flow channel at the mouth end of the core member; and, an air permeable tipping material circumscribing the core member and overlapping a portion of the tobacco column to attach the core member to the tobacco column, and the air permeable tipping material including air flow through means in flow communication with the at least one air flow channel.

19. The cigarette of claim 18, wherein the circumscribing tipping material extends longitudinally of the core member beyond the mouth end thereby defining a recessed area at the mouth end of the core member.

20. The cigarette of claim 18 further comprising:

an air permeable wrapper circumscribing the core number; and, the tipping material circumscribing the wrapped core member.

* * * * *